United States Patent [19]

Hasker et al.

[11] Patent Number: 4,873,052

[45] Date of Patent: Oct. 10, 1989

[54] METHOD OF MANUFACTURING A SCANDATE DISPENSER CATHODE AND SCANDATE DISPENSER CATHODE MANUFACTURED ACCORDING TO THE METHOD

[75] Inventors: Jan Hasker; Johannes Van Esdonk, both of Eindhoven; Wim Kwestroo, Lieshout, all of Netherlands

[73] Assignee: U.S. Philips Corporaton, New York, N.Y.

[21] Appl. No.: 899,788

[22] Filed: Aug. 22, 1986

Related U.S. Application Data

[63] Continuation of Ser. No. 689,542, Jan. 7, 1985, abandoned.

[30] Foreign Application Priority Data

Oct. 5, 1984 [NL] Netherlands ..... 8403031

[51] Int. Cl.[4] ..... C22C 29/12

[52] U.S. Cl. ..... 419/2; 419/19; 419/27

[58] Field of Search ..... 428/550, 552, 565; 419/2, 6, 19, 20, 27, 58

[56] References Cited

U.S. PATENT DOCUMENTS

| | | | |
|---|---|---|---|
| 2,813,807 | 11/1957 | Levi | 117/224 |
| 3,265,495 | 8/1966 | Freytag et al. | 75/208 |
| 4,594,220 | 6/1986 | Hasker et al. | 419/27 |
| 4,625,142 | 11/1986 | Van Esdonk et al. | 313/346 DC |
| 4,698,096 | 10/1987 | Schmidberger et al. | 75/248 |

FOREIGN PATENT DOCUMENTS

| | | | |
|---|---|---|---|
| 59203343 | 11/1986 | Japan | 252/515 |
| 8201371 | 11/1983 | Netherlands . | |
| 2116356 | 9/1983 | United Kingdom . | |

OTHER PUBLICATIONS

Hausher, Handbook of Powder Metallurgy, 1973, pp. 13 and 15.

*Primary Examiner*—Stephen J. Lechert, Jr.
*Assistant Examiner*—Eric Jorgensen
*Attorney, Agent, or Firm*—Norman N. Spain

[57] ABSTRACT

A method of manufacturing a scandate dispenser cathode having a matrix (1) at least the top layer of which consists substantially of a mixture of tungsten with scandium oxide or with a mixed oxide comprising scandium oxide. When sintering of the matrix is carried out at a temperature between 1300° and 1700° C., preferably at approximately 1500° C. and in a hydrogen atmosphere, cathodes are obtained having a better recovery after ion bombardment compared with cathodes sintered at 1900° C. Sintering in hydrogen results in a better reproducibility.

4 Claims, 1 Drawing Sheet

Figure 1:
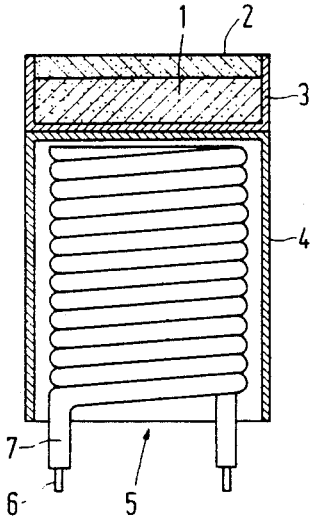

METHOD OF MANUFACTURING A SCANDATE DISPENSER CATHODE AND SCANDATE DISPENSER CATHODE MANUFACTURED ACCORDING TO THE METHOD

This is a continuation of application Ser. No. 689,542, filed Jan. 7, 1985, now abandoned.

The invention relates to a method of manufacturing a scandate dispenser cathode having a matrix at least the top layer of which consists substantially of a mixture of tungsten (W) with scandium oxide ($Sc_2O_3$) or with a mixed oxide comprising scandium oxide.

The invention also relates to a scandate dispenser cathode manufactured according to the method.

Such cathodes are used as electron source in television display tubes, camera tubes, oscilloscope tubes, klystrons, transmitter tubes, etc.

The property of such dispenser cathodes is that there is a functional separation between on the one hand the electron-emissive surface and on the other hand a store of the emissive material which serves to produce a sufficiently low work function of said emissive surface. One of the types of dispenser cathodes is the L-cathode. The emission of an L-cathode takes place from the surface of a porous matrix of, for example, tungsten the work function of which is reduced by adsorbed barium (Ba) and oxygen (O). Below said matrix the L-cathode has a storage space in which a mixture of tungsten powder and emissive material, for example, barium-calcium aluminate, is present. The adsorbate at the surface is maintained by means of reactions of this mixture. A second type of dispenser cathode is the impregnated cathode which is obtained by impregnating a compressed and sintered porous tungsten member with emissive material. In this case the required adsorbate is obtained by means of reaction of the emissive material with the tungsten of the matrix.

A method of the type described in the opening paragraph is known from British Patent Application 2,116,356 laid open to public inspection. This Application describes that the matrix is presintered in a hydrogen atmosphere at 1000° to 1200° C. to remove a binder and make the matrix easier to handle. The ultimate sintering of the matrix takes place in a vacuum at 1700°-2000° C.

Such a method is also described in Netherlands Patent Application 8201371 (PHN 10,308) laid open to public inspection which may be considered to be incorporated herein. In this Patent Application sintering takes place at 1900° C.

The scandate dispenser cathodes manufactured according to the latter method had a reasonable to moderate recovery after ion bombardment. It is therefore an object of the invention to provide a method of manufacturing a scandate dispenser cathode the recovery of which after ion bombardment is better. Another object of the invention is to realize this in combination with a long life.

For that purpose, a method of the type described in the opening paragraph is characterized according to the invention in that sintering of the matrix is carried out at a temperature between 1300° and 1700° C. As will be demonstrated hereinafter, the recovery of the emission after ion bombardment of cathodes sintered at a temperature between 1300° C. and 1700° C., preferably at approximately 1500° C., is better than of cathodes sintered at approximately 1900° C.

Sintering is preferably carried out in a hydrogen atmosphere because very reproducible cathodes are then obtained. The series standard deviation of $I(O)_{1000}$ is only 3% for cathodes which are sintered in hydrogen and according to the invention and which consist at least at the surface of a mixture of tungsten (W) with 5% by weight of scandium oxide ($Sc_2O_3$). $I(O)_{1000}$ is the current measured directly after activating the cathode in a 1000 V pulse.

A scandate dispenser cathode manufactured by means of the method according to the invention preferably comprises a matrix at least the top layer of which consists of a mixture of tungsten and pure scandium oxide. As will be demonstrated hereinafter, scandium oxide in a mixed oxide has a reduced activity after ion bombardment. Pure scandium oxide is therefore used preferably. For a tungsten matrix with a top layer of a mixture of tungsten and scandium oxide, the quantity of taken-up impregnant—at the same porosity—is approximately a factor of two larger than for a matrix consisting of the same mixture of tungsten and scandium oxide. In connection with a desired long life, the use of a top layer is hence desired according.

to an embodiment of the invention a scandate dispenser cathode manufactured according to the method of the invention is an impregnated cathode in which the quantity of impregnate incorporated in the matrix is between 2 and 6% by weight of the total impregnated matrix.

Figure 2:
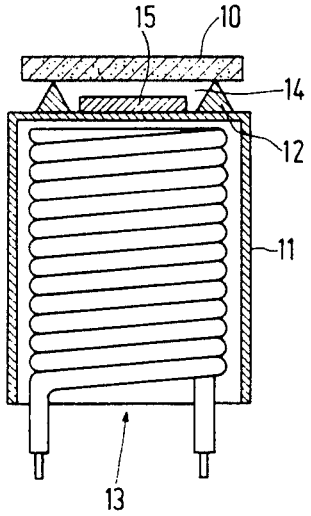

The invention will now be described in greater detail, by way of example, with reference to a number of examples and a drawing, in which FIG. 1 is a longitudinal sectional view of an impregnated cathode according to the invention, and FIG. 2 is a longitudinal sectional view of an L-cathode according to the invention.

FIG. 1 is a longitudinal sectional view of a scandate dispenser cathode according to the invention. The cathode body 1 having a diameter of 1.8 mm has been obtained by compressing a matrix having a top layer 2 of tungsten with scandium oxide ($Sc_2O_3$). After sintering and cooling, the cathode body 1 consists of an approximately 0.1 mm thick scandium oxide-containing porous tungsten layer on a 0.4 mm thick porous tungsten layer. The cathode body is then impregnated with barium-calcium aluminate. The said impregnated cathode body, whether or not compressed in a holder 3, is then welded on a cathode shank 4. A coiled cathode filament 5 consisting of a helically wound metal core 6 and an aluminium oxide insulating layer 7 is present in the cathode shank 4.

The recovery of a cathode after ion bombarment is important. As a matter of fact, during processing and/or during operation, cathodes in tubes are exposed to a bombardment of ions originating from residual gases. This recovery has been measured on diodes having an anode which can be fired separately from the cathode in a high-vacuum arrangement. The emission is measured in a 1500 V pulse across the diode with a diode spacing (distance cathode-anode) of 300 μm. After activating the cathode in a vacuum, $10^{-5}$ torr argon were introduced into the system. With 1.5 kV pulse at the anode (10 Hz frequency) with such a pulse length that at the beginning the anode dissipation is 5 Watt, current was drawn for 40 minutes, in which said current gradually decreases more or less. The cathode temperature (molybdenum brightness) was 1220° K. The argon was then removed by pumping. The cathode was then allowed to recover for 2 hours at 1200° K. with a current density of a A/cm$^2$, succeeded by 1 hour at 1320° K. at 1 A/cm$^2$. During this recovery the current at +1500 V pulse at the anode was measured every 10 minutes and compared with the initial value. The said cycle of sputtering and recovery was then repeated once again. The current measure right after activation in a +1500 V pulse is indicated by $I(O)_{1500}$ and the current after the described two cycles by $I(e)_{1500}$. The ration $I(e)_{1500}/I(O)_{1500}$ is a measure of the recovery H(%) after ion bombardment. Prior art cathodes and cathodes according to the invention sintered at various temperatures $T_s$ (°C.) are compared with each other in the table below. The quantity of impregnant taken up in percent by weight Imp(%), the emission after 100 hours in a 1000 V pulse $I_{1000}$ and the recovery H(%) are recorded in the Table. In both cases the top layer consists of a mixture of 5 percent by weight of $Sc_2O_3$ grains and tungsten grains. In the second case the material has been compressed during sintering by a larger pressure $P_s$ so as to reach the same porosity, for a fair comparison. It will be seen from the Table that at low sintering temperature the recovery after ion bombardment occurs better than at high sintering temperature. It is furthermore to be noted that 5% $Sc_2O_3$ is optimum for the emission. For 2% and 10%, respectively, the value of $I_{1000}$ at $T_s$=1900° C., is 2850 and 2650 mA, respectively, for 1.8 mm cathode diameter.

| | (Atm) | $T_s$ (°C.) | Imp (%) | $I_{1000}$ (mA) | H (%) |
|---|---|---|---|---|---|
| $Sc_2O_3$ + W | 2 | 1900 | 4.2 | 3000 | 65 |
| top layer on W | 3.5 | 1500 | 4.2 | 3000 | 75 |

When $Sc_6WO_{12}$ in the top layer is used instead of $Sc_2O_3$, $I_{1000}$—again at $T_s$=1900° C. and an impregnant take-up of 4.2%—is again as large as possible at approximately 9% by weight. The value of $I_{1000}$, however, then is 5% lower than the values in the table, while H is only 52%. This demonstrates the reduced activity of $Sc_2O_3$ in the mixed oxide $Sc_6WO_{12}$.

FIG. 2 is a longitudinal sectional view of an L-cathode according to the invention. The cathode body 10 is compressed from a mixture of 5% $Sc_2O_3$ and 95% W and then sintered. Said cathode body 10 is placed on a molybdenum cathode shank 11 having an upright edge 12. a cathode filament 13 is present in the cathode shank 11. A store 15 of emissive material (for example, barium-calcium aluminate mixed with tungsten) is present in the hollow space 14 between the cathode body 10 and the cathode shank 11.

What is claimed is:

1. A method of manufacturing a scandate dispenser cathode having a matrix at least the top layer of which consists substantially of a mixture of tungsten (W) with scandium oxide ($Sc_2O_3$) or with a mixed oxide comprising scandium oxide, characterized in that the matrix is sintered at a temperature between 1300° and approximately 1500° C. in hydrogen.

2. A scandate dispenser cathode manufactured by means of a method as claimed in claim 1, characterized in that the matrix is a tungsten matrix having a top layer of a mixture of scandium oxide and tungsten.

3. A scandate dispenser cathode manufactured by means of a method as claimed in claim 2, characterized in that it is an impregnated cathode and the quantity of impregnant incorporated in the matrix is between 2 and 6% by weight of the total impregnated matrix.

4. A method as claimed in claim 1, characterized in that sintering is carried out at a temperature of approximately 1500° C.

* * * * *